United States Patent [19]

Meuller et al.

[11] 4,083,025

[45] Apr. 4, 1978

[54] WINDINGS FOR MAGNETIC LATCHING REED RELAY

[75] Inventors: Von W. Meuller, Elk Grove; Ronald A. Foerster, Carol Stream, both of Ill.

[73] Assignee: GTE Automatic Electric Laboratories Incorporated, Northlake, Ill.

[21] Appl. No.: 689,882

[22] Filed: May 25, 1976

[51] Int. Cl.[2] ..... H01H 51/27

[52] U.S. Cl. ..... 335/153; 335/151

[58] Field of Search ..... 335/153, 151

[56] References Cited

U.S. PATENT DOCUMENTS 3,793,601 2/1974 Angner et al. ..... 335/153

*Primary Examiner*—Harold Broome

[57] ABSTRACT

A magnetic latching relay includes three control windings disposed about an encapsulated reed switch having a pair of reeds constructed of a remanent magnetic material. A first winding is disposed about one reed and second and third windings are disposed about the other reed. The windings are arranged so that a current pulse applied to the first and second winding generates magnetic flux fields in the same direction that produce magnetic poles of opposite polarity at the contacting ends of the reeds and causes the contacting ends to close while a current pulse applied to the first and third windings generates magnetic flux fields in the opposite direction that in turn produces magnetic poles of like polarity at the contacting ends and causes the contacting ends to open.

13 Claims, 3 Drawing Figures

WINDINGS FOR MAGNETIC LATCHING REED RELAY

BACKGROUND OF THE INVENTION

1. Field of the Invention

This invention relates to electromagnetic switching devices and particularly to an improved magnetic latching reed relay.

2. Description of the Prior Art

One type of a magnetic latching read relay includes a pair of reeds made from a magnetic material which, when exposed to a magnetic flux, will assume a magnetic state and remain in that state until exposed to a magnetic flux of opposite direction. The ends of the reeds overlap to function as a pair of normally open contacts. An example of such a relay is taught by U.S. Pat. No. 3,059,075 issued to R. L. Peek on Oct. 16, 1962.

Various arrangements of control windings have been employed with magnetically latched reed relays. One such arrangement is taught by U.S. Pat. No. 3,037,085 issued to T. N. Lowry on May 29, 1962. That arrangment employs the principle of differential excitation and employs two pairs of windings connected so that the relay is released, i.e., the contact pair is opened, by applying a current pulse to one pair of windings and the relay is operated, i.e., the contact pair is closed, by concurrently applying pulses of the same polarity to both pairs of windings.

Another control winding arrangement taught by U.S. Pat. No. 3,793,601 issued to R. J. Anger et al. on Feb. 19, 1974 operates or releases the reeds with a single pulse. Each of a pair of identical release windings is arranged over a corresponding one of a pair of reeds. The release windings are series connected so that a single pulse applied to the windings causes a magnetic field of one direction to be produced around one reed and a magnetic field of an opposite direction to be produced around the other reed. The resultant magnetic flux is such that the contact ends of the reeds are of the same magnetic polarity and thus separate. An operate winding in association with one of the two release windings is wound in a manner to produce a magnetic flux magnitude greater than the magnitude magnetic flux generated by the associated release winding and having a flux direction opposite to the flux direction produced by the associated release winding. The operate winding is series connected to the associated release winding so that a single current pulse flowing through the operate and the pair of release windings causes the contact ends of the reeds to have magnetic states of opposite polarity with the result that the contact ends of the reeds attract whereby the contact pair is closed.

The arrangement taught by the Anger patent has an inefficiency in its operation to close the reed contacts in that the operate winding must generate a magnetic field of sufficient strength to overcome the magnetic field concurrently produced by one of the release windings.

SUMMARY OF THE INVENTION

A preferred embodiment of the present magnetic latching reed relay has three windings. In accordance with the principles of this invention a first or common winding is positioned over one of a pair of reeds constructed of a remanent magnetic material; an operate winding and a release winding are located over the other reed. The operate winding is serially connected with the common winding in a manner that a current pulse flowing through the common and operate windings causes magnetic fields to be produced around both reeds in the same direction. The resultant magnetic flux is such that the free ends of the reeds have opposite magnetic polarity and thus attract thereby closing an electrical path. The release winding is serially connected with the common winding in a manner that a current pulse flowing through the common winding and the release winding causes a magnetic flux field of one direction to be produced around one reed and a magnetic flux field of an opposite direction to be produced around the other reed. The magnitude of the flux produced by the release winding is greater than the magnitude of the flux produced by the operate winding and has a flux direction opposite to the flux direction produced by the operate winding. A current pulse flowing through the common and release windings produces a resultant magnetic flux such that the free ends of the reeds have the same magnetic polarity and thus repel each other whereby the electrical path is opened.

DESCRIPTION OF THE DRAWINGS

The invention may best be understood by reference to the following description taken in conjunction with the accompanying drawing in which like reference numerals indentify like elements in the several figures and in which.

DESCRIPTION OF THE PREFERRED EMBODIMENT

Figure 1:
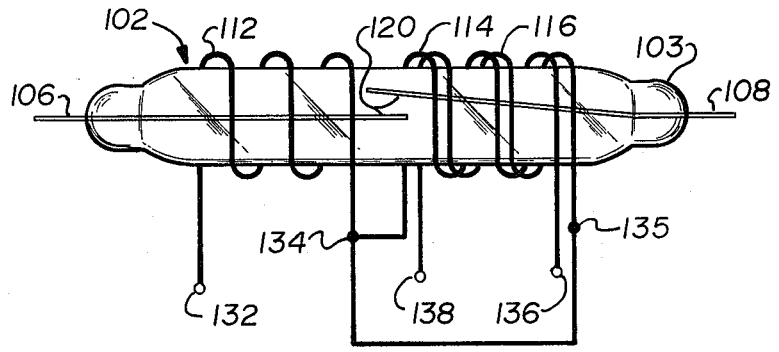
FIG. 1 is a view, partially schematic, of one embodiment of a magnetic latching reed relay in accordance with the principles of this invention.

The read relay illustrated in FIG. 1 includes a reed switch shown generally at 102 which comprises a pair of reeds 106 and 108 sealed in a glass envelope 103. The free ends of the reeds 106 and 108 overlap and are coated with a highly conductive material to form contacts 120. Each of the reeds 106 and 108 is constructed of a remanent magnetic material exhibiting a plurality of stable magnetic states and which retains its last-set magnetic state. These magnetic states are established exclusively by three control windings 112, 114 and 116. A first or common winding 112 is positioned over one reed 106. The second or operate winding 114 and the third or release winding are positioned over the other reed 108.

The common winding 112 is wound in what is assumed to be clockwise direction from the terminal 132 to the common terminal 134. The operate winding 114 is wound in the same direction from the common terminal 134 to the terminal 136. The release winding is wound in the same direction from the terminal 138 to the terminal 135 which is in turn connected to the common terminal 134. The windings are wound so that the common and operate windings 112 and 114 each have $m$ turns of wire and the release winding 116 has $n$ turns of wire, where $n$ is greater than $m$. In the illustrative embodiment of the invention, the common and operate windings 112 and 114 each have 45 turns of 34 gauge insulated copper wire and the release winding 116 has 68 turns of 34 gauge insulated copper wire. As is clearly illustrated in FIG. 2, the common winding 112 is serially connected to both the operate and release windings 114 and 116 so that a series electrical path may be established through the common and operate windings 112 and 114 or through the common and release windings 112 and 116. The windings are connected so that the common winding 112 and the operate winding 114 are of the same magnetic sense and the release winding 116 is of the opposite magnetic sense. The magnetic sense of each winding is indicated in FIG. 2 and FIG. 3 by means of a dot.

Figure 2:
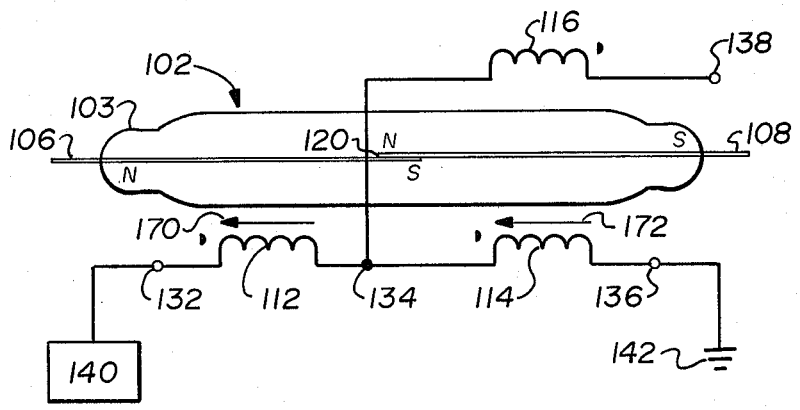
FIG. 2 is a schematic representation of the relay of FIG. 1 showing the direction of the magnetic flux fields produces by the common and operate windings.

With reference now to FIG. 2, the magnetic fields produced during the operation of the relay will be described. A current pulse source 140 is connected to the terminal 132 and a ground 142 is connected to the terminal 136 so that a current pulse generated by the pulse source 140 flows from left to right through the series combination of the common and operate windings 112 and 114. The current flow through the common winding 112 produces a flux field of a first magnitude about the reed 106 having a first magnetic direction indicated by the arrow 170 thereby creating magnetic poles N and S on the reed 106 as shown. The current flow through the operate winding 114 produces a flux field about the reed 108 also having the first magnetic direction as indicated by the arrow 172 thereby creating magnetic poles N and S on the reed 108 as shown. The flux field produces about the reed 108 is approximately equal in magnitude to the flux field produced about the reed 108. The free ends of the reeds 106 and 108 are of opposite magnetic polarity and therefore attract each other with the result that the contacts 120 close. As stated hereinabove, the reeds 106 and 108 are of a remanent magnetic material that retains its last-set magnetic state. Therefore, at the termination of the current pulse, the reeds 106 and 108 will retain their respective magnetic orientations and the contacts 120 will remain closed.

Figure 3:
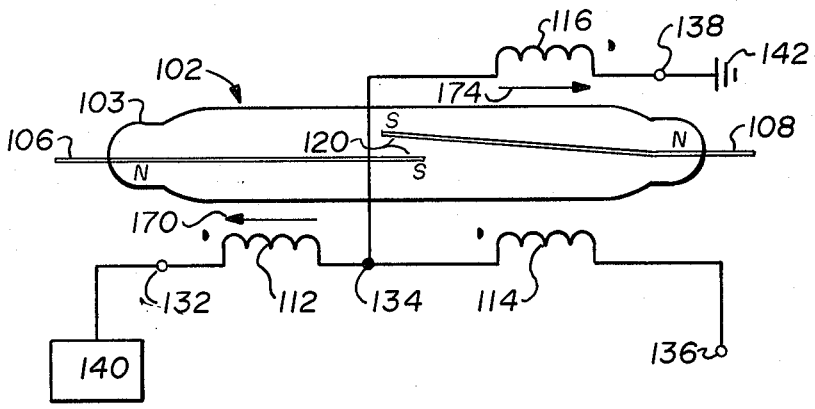
FIG. 3 is a schematic representation of the relay of FIG. 1 showing the direction of the magnetic flux fields produced by the common and release windings.

With reference to FIG. 3 the magnetic fields produced for releasing the relay, i.e., opening the contacts will be described. The current pulse source 140 remains connected to the terminal 132. The ground 142 is now connected to the terminal 138 so that a current pulse generated by the current pulse source 140 flows from left to right through the series combination of the common and release windings 112 and 116. The current flow through the common winding 112 produces a flux field of a first magnitude and having a magnetic direction as illustrated by the arrow 170 thereby creating magnetic poles N and S on the reed 106 as shown. The current flow through the release winding 116 produces a flux field of a second magnetic direction as illustrated by the arrow 174. The magnetic flux field produced by the release winding 116 is opposite in magnetic direction to and greater in magnitude than the magnetic flux field produced by the operate winding 114 during relay operation so that the remanent magnetism of the reed 108 as a result of the relay operation, is overcome and the reed 108 will assume a remanent magnetic orientation in the opposite direction. The magnetic flux field produced by the release winding 116 is also greater in magnitude and of opposite magnetic than the magnetic flux field produced by the common winding 112. As a result, the magnetic flux field of the release winding 116 overpowers the magnetic flux field of the operate winding so that the south magnetic pole S that it produces is displaced to the left of the midpoint of the reed switch. Under the conditions described above, the reeds 106 and 108 repel each other thereby causing the contacts 120 to open or separate. At the termination of the current pulse the fields generated by the windings 112 and 116 collapse and the reeds retain the magnetic orientation illustrated in FIG. 3 and the contacts 120 remain open.

In the illustrative embodiment of this invention the current pulses for both operation and release of the relay are 2.5 ± 0.5 amperes for a duration of 1.44 milliseconds.

It is to be understood that the above-described arrangement is illustrative of the principles of this invention. Numerous other arrangements may be devised by those skilled in the art without departing from the spirit and scope of the invention.

What is claimed is:

1. A relay having a pair of remanently magnetic members with free ends movable with respect to each other to close an electrical path when the members are each magnetized in the same direction and to open the electrical path when the members are each magnetized in an opposite direction, comprising:

first means for establishing a first magnetic direction with respect to a first one of the members;

second means for establishing the first magnetic direction with respect to a second one of the members;

third means for establishing a second magnetic direction with respect to the second member, the second magnetic direction being opposite from the first magnetic direction;

said second means being selectively energizable with said first means so that a first single concurrent application of energy only to said first and said second means produces said first magnetic direction with respect to the first and second members thereby causing the first and second members to attract and close the electrical path; and said third means being selectively energizable with said first means so that a second single application of energy only to said first and said third means produces the first magnetic direction with respect to the first member and the second magnetic direction with respect to the second member thereby causing the first and second members to release and open the electrical path.

2. A relay according to claim 1 wherein said first and second means are windings each having $m$ turns of wire.

3. A relay according to claim 2 wherein said third means is a winding having $n$ turns of wire where $n$ is a number greater than $m$.

4. A relay according to claim 1 wherein said first and second means respectively produce first and second magnetic flux fields of strength $y$, each said field having the same direction of magnetization.

5. A relay according to claim 4 wherein said third means produces a third magnetic flux field of strength $z$ where $z$ is greater than $y$, said third magnetic flux field being produced primarily around said second member and having a direction of magnetization opposite from that produced by said second means.

6. A reed relay having a pair of remanently magnetic members with free ends movable with respect to each other to close an electrical path when the members are each magnetized in the same direction and to open the electrical path when the members are each magnetized in an opposite direction, comprising:

first energizable means for altering the remanent magnetization of a first one of the members, to produce a first magnetic pole at the free end of the first member;

second energizable means for altering the remanent magnetization of a second one of the members to produce a second magnetic pole at the free end of the second member, said second magnetic pole being of opposite magnetic polarity from said first magnetic pole;

third energizable means for altering the remanent magnetization of the second member to produce the first magnetic pole at the free end of the second member;

said second energizable means being selectively operable with said first energizable means so that the first magnetic pole is produced at the free end of the first member and the second magnetic pole is produced at the free end of the second member thereby causing the free ends of the members to attract and close the electrical path in response to concurrent energization of only said first and said second energizable means; and said third energizable means being selectively operable with said first energizable means so that the first magnetic pole is produced at the free ends of the first and second members thereby causing the free ends of the members to repel and open the electrical path in response to concurrent energization of only said first and said third energizable means.

7. A reed relay according to claim 6 wherein said first energizable means is a first winding and said second energizable means is a second winding, said first and second windings each having *m* turns of wire.

8. A reed relay according to claim 7 wherein first and second windings are separated from each other by a non-magnetic material.

9. A reed relay according to claim 7 wherein said third energizable means is a third winding having *n* turns of wire where *n* is a number greater than *m*.

10. A reed relay comprising:

an encapsulated reed switch having a pair of cooperating reeds constructed of a remanently magnetic material, the two reeds overlapping each other at one of their ends to form a pair of contacts;

a first winding positioned about a first one of said reeds;

a second winding positioned about the second one of said reeds and connected in series with said first winding so that a current pulse applied only to said first and second windings produces a magnetic flux field around said first reed equal in magnitude and in the same direction as a magnetic flux field produced around said second reed;

a third winding positioned about said second reed and connected in series with said first winding so that a current pulse applied to only said first and third windings produces a flux field around said second reed of a magnitude greater than and in a direction opposing the flux field produced by said first winding.

11. A reed relay in accordance with claim 10 wherein said first and second windings each have *m* turns of wire.

12. A reed relay in accordance with claim 11 wherein said third winding has *n* turns of wire where *n* is a greater number than *m*.

13. A reed relay in accordance with claim 12 wherein said second and third windings are separated from said first winding by a spacer constructed from non-magnetic material.

* * * * *